US010023361B2

(12) United States Patent
Kent et al.

(10) Patent No.: US 10,023,361 B2
(45) Date of Patent: Jul. 17, 2018

(54) DRAW TAPE BAG

(75) Inventors: Gregory Stuart Kent, Plainfield, IL (US); Shaun T. Broering, Fort Thomas, KY (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 12/471,727

(22) Filed: May 26, 2009

(65) Prior Publication Data

US 2010/0303388 A1 Dec. 2, 2010

(51) Int. Cl.

| | |
|---|---|
| ***B65D 33/28*** | (2006.01) |
| ***B31B 70/00*** | (2017.01) |
| *B31B 160/10* | (2017.01) |
| *B31B 70/18* | (2017.01) |
| *B31B 155/00* | (2017.01) |

(52) U.S. Cl.

CPC ..... *B65D 33/28* (2013.01); *B31B 70/00* (2017.08); *B31B 70/18* (2017.08); *B31B 2155/00* (2017.08); *B31B 2155/001* (2017.08); *B31B 2155/0014* (2017.08); *B31B 2160/10* (2017.08)

(58) Field of Classification Search

CPC ..... B65D 33/28; B31B 2155/00; B31B 2155/001; B31B 2155/0014; B31B 70/00; B31B 70/18

USPC ..... 383/75, 33; 220/495.11

See application file for complete search history.

(56) References Cited

U.S. PATENT DOCUMENTS

| | | | | |
|---|---|---|---|---|
| 3,491,185 | A | 1/1970 | Rasmussen | |
| 3,738,567 | A | 6/1973 | Ruda | |
| 3,795,338 | A | 3/1974 | Swatzbaugh et al. | |
| 4,276,483 | A | 6/1981 | Hayden | |
| 4,401,427 | A | 8/1983 | Benoit et al. | |
| 4,598,833 | A | 7/1986 | Herr | |
| 4,628,536 | A | 12/1986 | Herrington | |
| 4,650,451 | A | 3/1987 | Herrington | |
| 4,726,483 | A | 2/1988 | Drozd | |
| 4,762,430 | A | 8/1988 | Bullard | |
| 4,802,582 | A * | 2/1989 | Johnson | 206/390 |
| 4,842,421 | A * | 6/1989 | Bullard et al. | 383/61.4 |
| 5,133,607 | A * | 7/1992 | Bonke | 383/75 |
| 5,205,650 | A | 4/1993 | Rasmussen | |
| 5,232,118 | A * | 8/1993 | Samuel | B65D 33/28 220/495.11 |
| 5,235,118 | A * | 8/1993 | Morris et al. | 568/862 |
| 5,390,875 | A | 2/1995 | Gietman et al. | |
| 5,411,157 | A | 5/1995 | King et al. | |
| 5,618,111 | A | 4/1997 | Porchia et al. | |
| 5,716,137 | A * | 2/1998 | Meyer | 383/75 |

(Continued)

FOREIGN PATENT DOCUMENTS

| | | |
|---|---|---|
| WO | 2000056635 A1 | 9/2000 |
| WO | 2004096535 A1 | 11/2004 |

(Continued)

*Primary Examiner* — Derek Battisti

(74) *Attorney, Agent, or Firm* — Thomas C. Feix

(57) ABSTRACT

The bag may include a draw tape that may be used to cinch closed the opening of the bag. The draw tape has at least one stretched elastomeric strip attached to the draw tape in an extended condition. The draw tape may be smaller in size than the bag sidewalls. The draw tape may include an elastic characteristic, such as patterned ribs. In one embodiment, the roll of bag is kept under tension to maintain the elastomeric strips in a stretched condition.

20 Claims, 9 Drawing Sheets

(56) References Cited

U.S. PATENT DOCUMENTS

| | | | | |
|---|---|---|---|---|
| 5,749,484 | A | 5/1998 | Trout | |
| 5,934,275 | A | 8/1999 | Gazzara et al. | |
| 6,059,458 | A * | 5/2000 | Belias et al. | 383/75 |
| 6,220,753 | B1 * | 4/2001 | Metzger | 383/33 |
| 6,394,651 | B2 | 5/2002 | Jackson | |
| 6,402,377 | B1 * | 6/2002 | Vo et al. | 383/75 |
| 6,695,476 | B2 | 2/2004 | Jackson et al. | |
| 6,939,042 | B2 * | 9/2005 | Rusnak et al. | 383/71 |
| 6,966,697 | B2 | 11/2005 | Patridge et al. | |
| 7,077,796 | B2 * | 7/2006 | Rusnak et al. | 493/215 |
| 7,946,765 | B2 * | 5/2011 | Melvan et al. | 383/43 |
| 2004/0086205 | A1 | 5/2004 | Raterman | |
| 2004/0097357 | A1 * | 5/2004 | Pihl et al. | 493/190 |
| 2004/0192529 | A1 | 9/2004 | Rusnak et al. | |
| 2004/0202388 | A1 | 10/2004 | Rusnak et al. | |
| 2005/0063622 | A1 | 3/2005 | Kannabrian | |
| 2005/0207681 | A1 * | 9/2005 | Raterman | 383/75 |
| 2005/0215964 | A1 | 9/2005 | Autran et al. | |
| 2006/0093766 | A1 | 5/2006 | Savicki | |
| 2006/0204716 | A1 | 9/2006 | Bonke | |
| 2007/0036472 | A1 * | 2/2007 | Persenda | 383/33 |
| 2007/0102389 | A1 | 5/2007 | Hoepner | |
| 2007/0144996 | A1 | 6/2007 | Sawyer | |
| 2008/0070994 | A1 | 3/2008 | Li | |
| 2008/0137995 | A1 * | 6/2008 | Fraser | B65F 1/0006 383/75 |
| 2008/0245466 | A1 | 10/2008 | Schmal et al. | |
| 2010/0046860 | A1 * | 2/2010 | Kent et al. | 383/75 |
| 2010/0172602 | A1 | 7/2010 | O'Donnell et al. | |

FOREIGN PATENT DOCUMENTS

| | | | |
|---|---|---|---|
| WO | 2007146877 | A1 | 12/2007 |
| WO | WO2007/146877 | | 12/2007 |

* cited by examiner

DRAW TAPE BAG

BACKGROUND OF THE INVENTION

Field of the Invention

This invention relates generally to bags having a draw tape. More particularly, the present invention relates generally to trash bags having a draw tape.

Description of the Related Art

Among their many applications, it is known to use thermoplastic bags as liners in trash or refuse receptacles. Trash receptacles that employ such liners may be found at many locations, such as, from small household waste baskets and kitchen garbage cans. The trash canisters are typically made from a rigid material such as metal or plastic. Bags that are intended to be used as liners for such refuse containers are typically made from low-cost, pliable thermoplastic material. When the receptacle is full, the thermoplastic liner actually holding the trash can be removed for further disposal and replaced with a new liner. To avoid inadvertently spilling the contents during disposal, the bags may be provided with a draw tape that allows for constricting or closing the open circumference of the bag. The draw tape may also be tied into a knot to simplify handling of the bag during disposal.

When being utilized as a trash canister liner, it is important that the bag be easily secured into the canister and as the full bag is removed that the open top part of the bag can be easily closed over the contents. U.S. Pat. No. 6,939,042 to Rusnak et al. discloses a plastic bag with a live elastic strip that contracts to restrict the opening.

Another potential difficulty is securing the bag to a canister which is larger than the bag mouth opening. If the canister is larger than the bag mouth opening, then the user cannot fold the bag over the rim of the canister. U.S. Pat. No. 6,059,458 to Belias et al. describes a drawtape bag where the drawtape section is gathered into one or more loops defining a series of crests and troughs, and each trough is sealed to the elastomeric strip. The elastomeric strip allows the mouth of the bag to be drawn over the upper portion of a trash container.

However, consumers still may have trouble inserting stretchy top bags into trash containers. Therefore, it is desirable to develop a simpler and quicker method of inserting and securing trash bag liners to trash canisters. It is also desirable to implement the inserting and securing method in such a manner that it is inexpensive and may be facilitated in a high speed manufacturing environment.

BRIEF SUMMARY OF THE INVENTION

In accordance with the principles of the present invention, in one embodiment, a draw tape bag comprises a first sidewall; a second sidewall, the second sidewall joined to the first sidewall by a closed bottom end, a first edge, and a second edge, thereby defining an open top end having a top surface with a top length; at least one of the sidewalls forming a hem having a top length and extending along the open top end disposed opposite the bottom end having a bottom length, the hem including one or more draw tape notches; a pliable thermoplastic draw tape in an extended state housed within the hem; a strip of elastic material having a fully relaxed length and a stretched expanded length, the elastic strip attached in the stretched expanded length condition to at least a first discrete region and a second discrete region of the extended draw tape, such that the hem is gathered together when the stretched elastic material attached to the draw tape is allowed to relax.

In an embodiment, a roll of draw tape bags comprises a plurality of bags, each bag including a first sidewall, a second sidewall joined to the first sidewall so as to define a closed bottom end, a first edge, a second edge, and an open top end; the plurality of bags arranged to define a length with the first sealed edge of at least one bag joined to the second sealed edge of an adjacent bag; at least one of the sidewalls forming a hem extending along the open top end disposed opposite the bottom end, the hem including one or more draw tape notches; a pliable thermoplastic draw tape in an extended state housed within the hem; a strip of elastic material having a relaxed condition and a stretched condition, the elastic strip stretched lengthwise under tension to an expanded stretched length; a first discrete region and a second discrete region along the length of the elastic strip attached in the stretched expanded length condition to a first discrete region and a second discrete region of the draw tape in the extended state; wherein the length of the plurality of bags is rolled together about an axis normal to the first and second edges of the bags to form a roll, the roll being perforated and continuous or interleaved, whereby the roll can prevent some attached elastic strips from returning to the relaxed condition or eliminate a bag folding step.

In one embodiment, the draw tape bag comprises a pair of pliable thermoplastic body panels joined to each other along a pair of opposing sides and a bottom bridging the opposing sides, at least one of the body panels forming a hem extending along a mouth end disposed opposite the bottom, the hem including one or more draw tape notches; a pliable thermoplastic draw tape in an extended state housed within the hem, the draw tape being partially exposed by the respective draw tape notches which allow the draw tape to be pulled therethrough to close the bag and to be used as a handle; and a stretched elastomeric strip having a first end and a second end wherein the first and second ends are connected to a first portion and a second portion respectively of an extended section of the draw tape.

In one embodiment, the method of manufacturing draw tape bags, comprising forming a flattened thermoplastic tube in a machine direction; dividing the thermoplastic tube into first and second portions along a dividing line extending in the machine direction, each of the portions including a pair of pliable thermoplastic sheets joined to each other along a bottom disposed in the machine direction, the sheets being separable from each other along a mouth end formed opposite the bottom; forming a hem on at least one of the sheets along the mouth end; forming draw tape notches in the hem at regular distance intervals corresponding to a desired width of the draw tape bags; inserting a pliable thermoplastic, extended draw tape into the hem, a stretched elastomeric strip having a first end and a second end, the first and second ends being connected to a first section and a second section of the draw tape respectively; and sealing the sheets to each other along side seal structures generally transverse to the machine direction to create individual draw tape bags.

The thermoplastic bag may be produced in a high speed manufacturing process that develops continuous sheet-like webs of thermoplastic material into the finished bag via automated equipment. The process may form hems along an edge of the advancing web for accommodating the draw tape. The process may provide a strip of tape material in a relaxed or pre-stretched condition, insert the strip into the hem, and form the side seals in the relaxed or pre-stretched condition. The process may provide a strip or strips of elastic material in a stretched state that is attached to the tape material and/or the hem. The stretched elastic material may be relaxed after or during the manufacture of the rest of the bag.

An advantage is that the elastic characteristic added to the hem or the draw tape enables the bag opening to gather to a relaxed state to allow the bag to have easier insertion into a trash container and to better secure itself to the container and may resist falling into the container. Another advantage of the thermoplastic bag is that it includes a draw tape that may be used to constrict the opening and reduce spillage of any contents. Another advantage is that the user may be able to stretch the bag opening to secure the bag to a canister which is larger than the bag mouth opening. A further possible advantage is that the thermoplastic bag may be produced by a high speed, low cost manufacturing process. These and other advantages and features of the thermoplastic bag will become apparent from the following description and accompanying drawings.

BRIEF DESCRIPTION OF THE DRAWINGS

The foregoing aspects and others will be readily appreciated by the skilled artisan from the following description of illustrative embodiments when read in conjunction with the accompanying drawings, in which.

DETAILED DESCRIPTION

Figure 1:
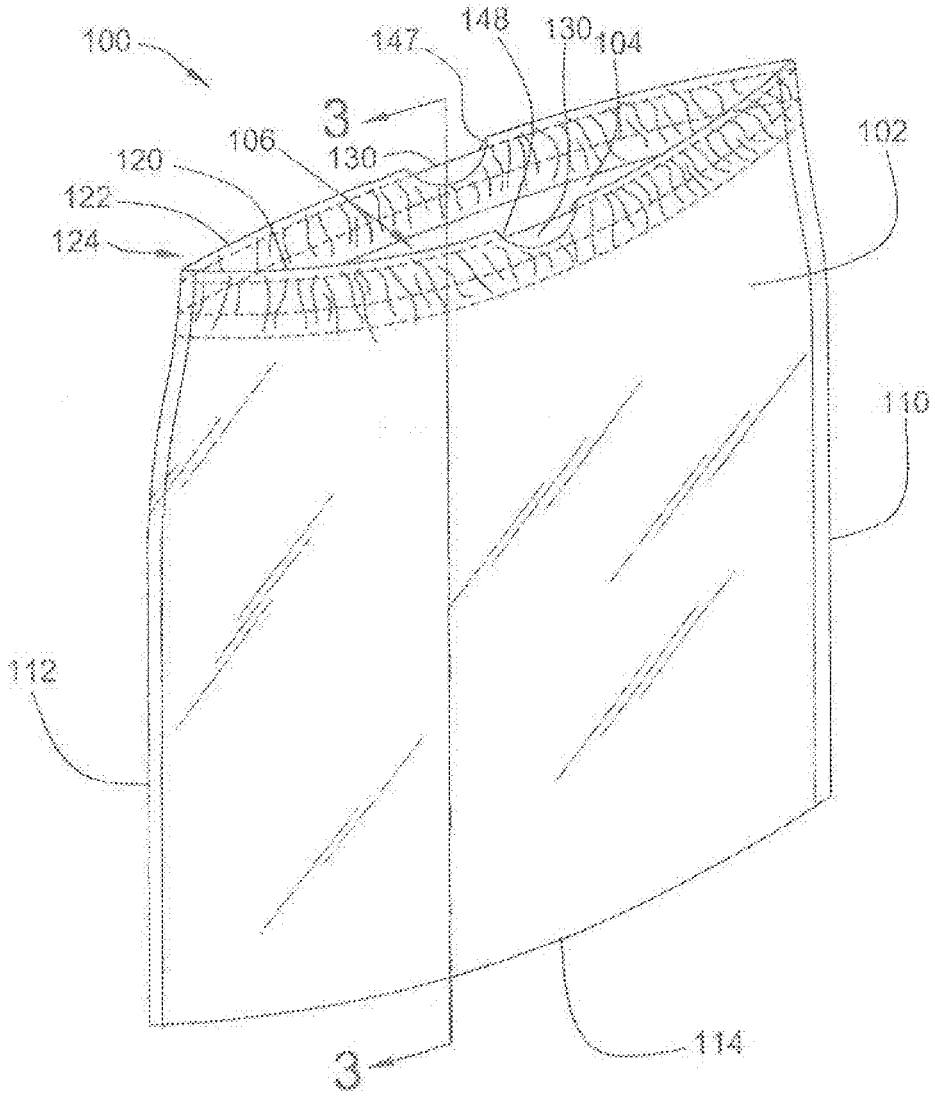
FIG. 1 is a perspective view of a thermoplastic bag having a draw tape in a contracted state that partially constricts the bag opening.

Reference will now be made to the drawings wherein like numerals refer to like parts throughout. For ease of description, the components of this invention are described in the normal (upright) operating position, and terms such as upper, lower, horizontal, top, bottom, etc., are used with reference to this position. It will be understood, however, that the components embodying this invention may be manufactured, stored, transported, used, and sold in an orientation other than the position described.

Figures illustrating the components of this invention show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

Referring to FIG. 1, there is illustrated a thermoplastic bag 100 of the kind useful as a liner for trash receptacles and refuse containers. Of course, the illustrated bag may have additional or different uses. The bag 100 may be made from a first sidewall 102 and opposing second sidewall 104 overlaid and joined to the first sidewall to define an interior volume 106 for holding trash. The first and second sidewalls may have matching rectangular or square shapes and may be joined along a first side edge 110, a second side edge 112 that may be parallel to and spaced apart from the first side edge, and a closed bottom edge 114 that extends between the first and second side edges. The sidewalls 102, 104 may be joined along their edges by any suitable joining process such as, for example, heat sealing in which the thermoplastic material bonds or melts together. Other sealing or joining processes may include ultrasonic methods and adhesive.

The first and second sidewalls 102, 104 may be made of flexible or pliable thermoplastic material formed or drawn into a smooth, thin-walled web or sheet. Examples of suitable thermoplastic materials may include polymers, for example, polyethylenes (such as, high density polyethylene, low density polyethylene, linear low density polyethylene, very low density polyethylene, ultra low density polyethylene), polypropylene, ethylene vinyl acetate, nylon, polyester, ethylene vinyl alcohol, ethylene-methyl acrylate, or polystyrene, and may be formed in combinations and in single or multiple layers. When used as a garbage can liner, the thermoplastic material will typically be opaque but could also be transparent, translucent, or tinted. Furthermore, the material used for the sidewalls may provide a fluid barrier, such as, a liquid barrier and/or a gas barrier and may include other features such as being treated with deodorants and/or disinfectants as is sometimes desirable in the production of trash can liners.

To access the interior volume 106, the top edges 120, 122 of the first and second sidewalls between the first and second side edges and which are located opposite the bottom edge 114 may remain un-joined to provide the periphery of an opening 124. When the bag 100 is placed in a trash receptacle, the top edges 120, 122 corresponding to the opening 124 are typically folded back over the rim to help retain the bag in a vertical position within the receptacle.

To close the opening 124 of the bag 100 when, for example, disposing of the trash receptacle liner, the bag may be fitted with a draw tape 130. To accommodate the draw tape 130, referring to FIG. 2, the top edges 120, 122 of the first and second sidewalls 102, 104 corresponding to the periphery of the opening 124 may include respective first and second hem flaps 140, 142. The first hem flap 140 may be folded back into the interior volume 106 and attached to the interior surface of the first sidewall 102 to form a first hem 144. Similarly, the second hem flap 142 of the second sidewall 104 is similarly folded back into the interior volume 106 and attached to the second sidewall to form a second hem 146. The hem flaps may be attached to the interior surfaces of the sidewalls by adhesive, heat seals or otherwise. In other embodiments, the hems may be formed by folding the hem flaps toward the exterior of the sidewalls and attaching them to the sidewall exterior surface, or the hems may be formed as separate elements that are attached to the sidewalls. To access the draw tape 130, as illustrated in FIG. 1, first and second notches 147, 148 may be disposed through the respective first and second top edges 120, 122. Pulling the draw tape 130 through the notches 147, 148 constricts the top edges 120, 122 thereby drawing closed the opening 124.

Figure 2:
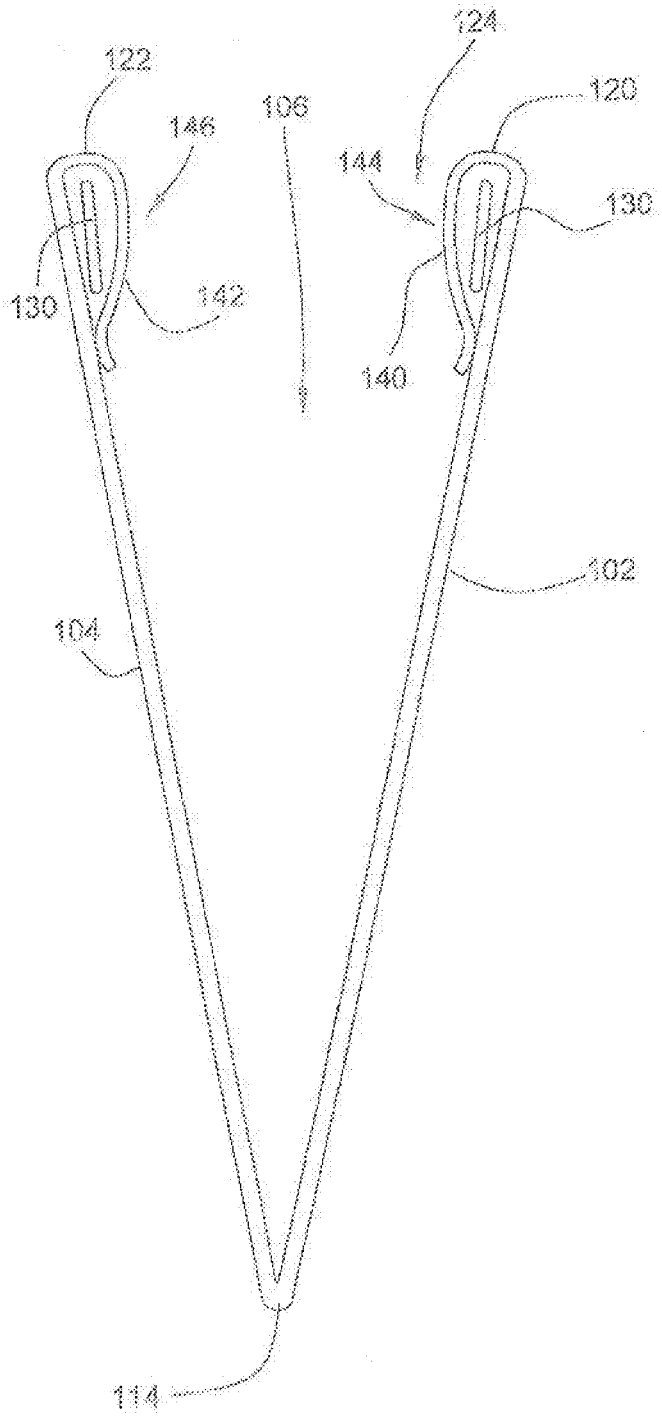
FIG. 2 is a cross-sectional view of the thermoplastic bag taken along line 3-3 of FIG. 1 and illustrating a draw tape accommodated in a hem.
Figure 3:
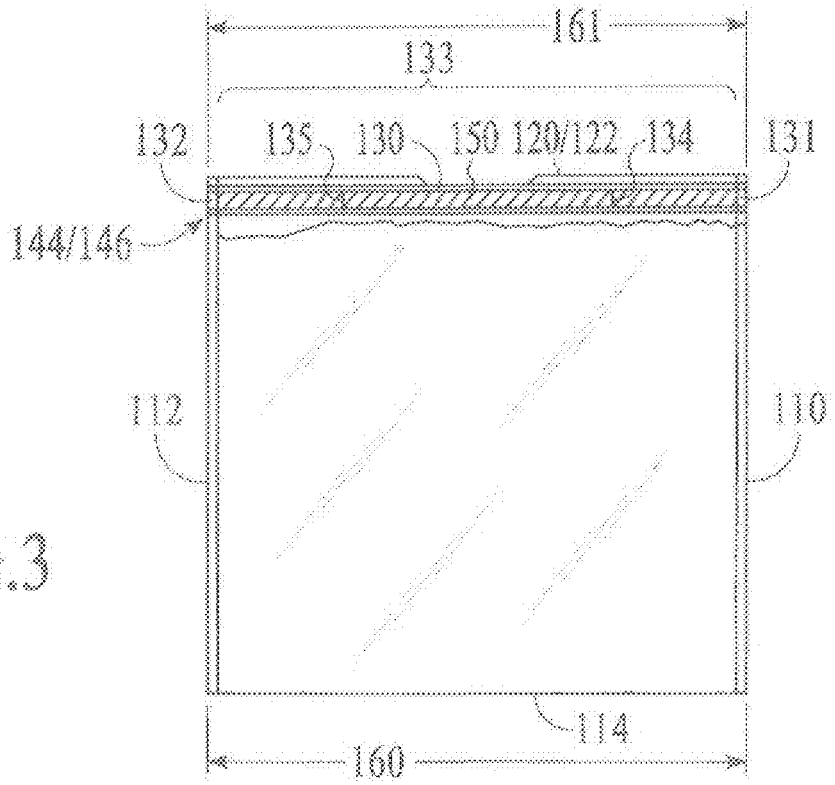
FIG. 3 is a partial cut away view of the thermoplastic bag showing the draw tape attached to the bag.
Figure 4:
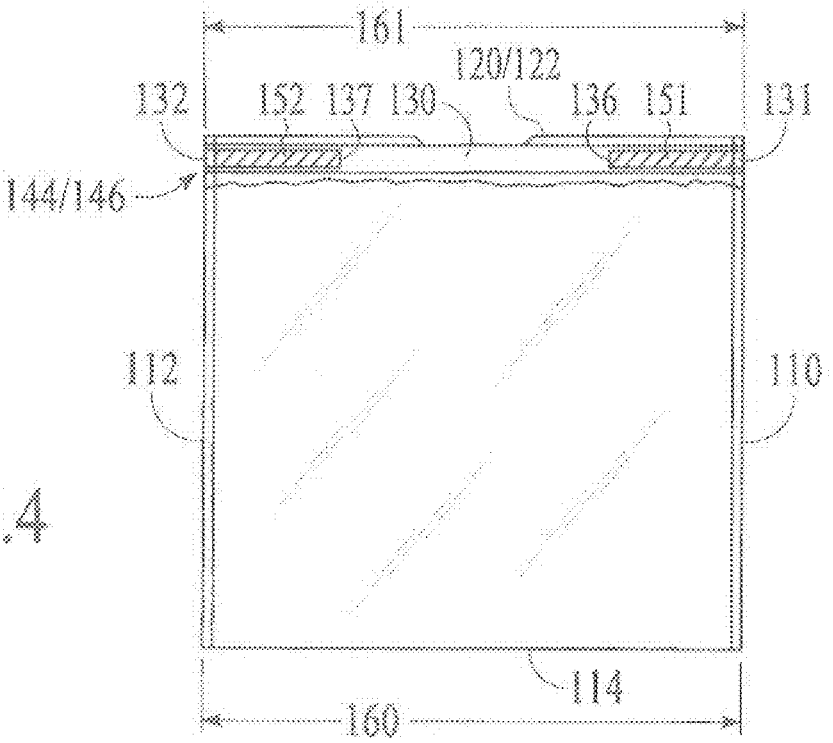
FIG. 4 is a partial cut away view of the thermoplastic bag showing the draw tape material having two stretched elastic strips and attached to the bag.
Figure 5:
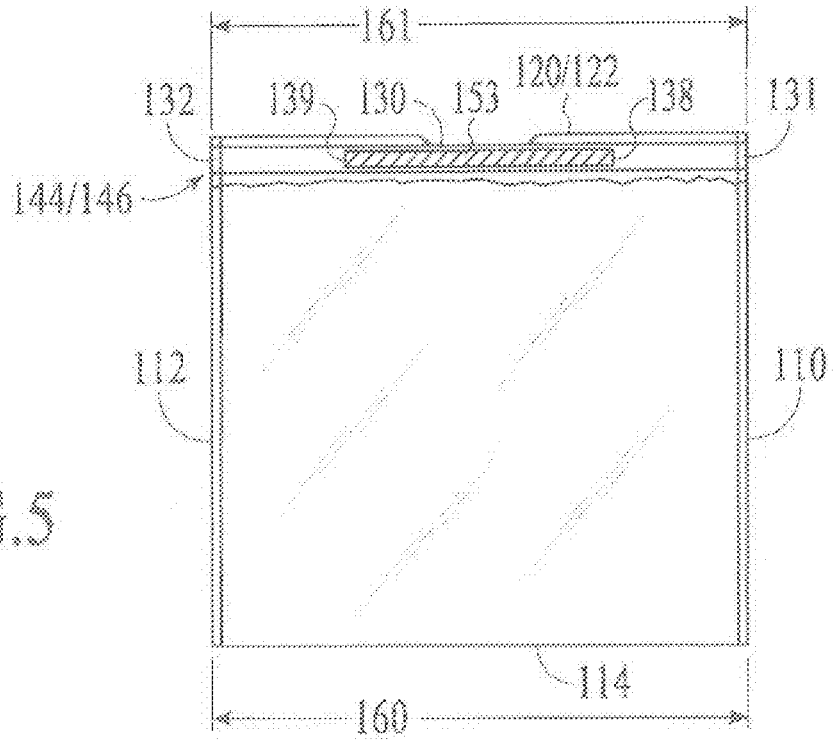
FIG. 5 is a partial cut away view of the thermoplastic bag showing the draw tape material having a stretched elastic strip and attached to the bag.
Figure 6:
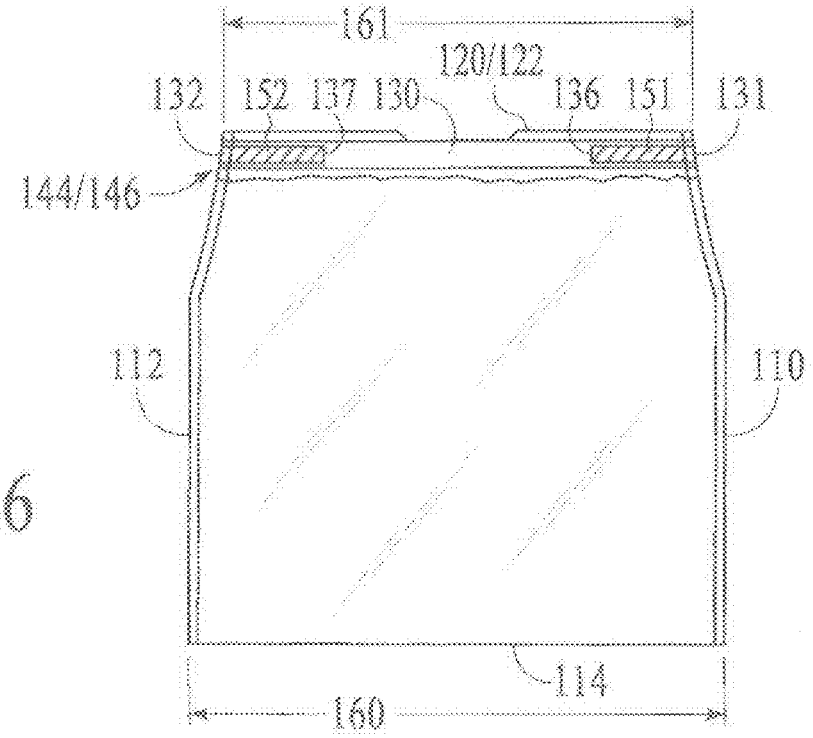
FIG. 6 is a partial cut away view of the thermoplastic bag of FIG. 4 showing the draw tape and elastic strips in the relaxed condition attached to the bag.

Referring to FIGS. 2 and 3, the draw tape 130 may be formed as an elongated strip of thermoplastic material. When inserted into the hems 144, 146, the draw tape first and second ends 131, 132 may be attached to the first and second sidewalls 102, 104 at the respective first and second side edges 110, 112 while the intermediate section 133 may extend loosely through the first and second hems 144, 146 proximately along the first and second top edges 120, 122. In those embodiments in which the bag is heat sealed together, the draw tape first and second ends 131, 132 may be heat sealed to and in-between the first and second sidewalls 102, 104 at the respective first and second edges 110, 112 to form a side seal. An expanded stretched elastic strip 150 may be attached to the fully extended draw tape 130 at the opposite first and second ends 131, 132 and at intermediate points 134, 135 in between. The extended draw tape 130 has length 161 between opposite first and second ends 131, 132 which are spaced apart by an intermediate section 133. The extended draw tape length 161 is equal to the bottom length 160. Referring to FIG. 4 showing two stretched elastic strips, one length of expanded stretched elastic strip 151 is attached to first end 131 and intermediate point 136 and another length of expanded stretched elastic strip 152 is attached to the draw tape 130 second end 132 and intermediate point 137. The extended draw tape 130 with the stretched elastic strips 151, 152 has length 161 equal to the bottom length 160. In other embodiments, the extended draw tape has a length longer than the bottom length. Referring to FIG. 5, one length of expanded stretched elastic strip 153 is attached to the draw tape 130 at intermediate point 138 and at intermediate point 139. The extended draw tape 130 with the stretched elastic strip 153 has length 161 equal to the bottom length 160. The elastic strip 153 is not attached to the hem 144, 146. The elastic strip 153 is not attached to the sidewall. FIG. 6 shows that when the draw tape 130 with the attached elastic strips 151, 152 at the top of bag 100 of FIG. 4 is allowed to relax, so that the elastic strips 151, 152 are allowed to relax into the unstretched condition, the top of the bag 100 and the hems 144, 146 gather so that the relaxed top length 162 is shorter than the bottom length 160.

Figure 7:
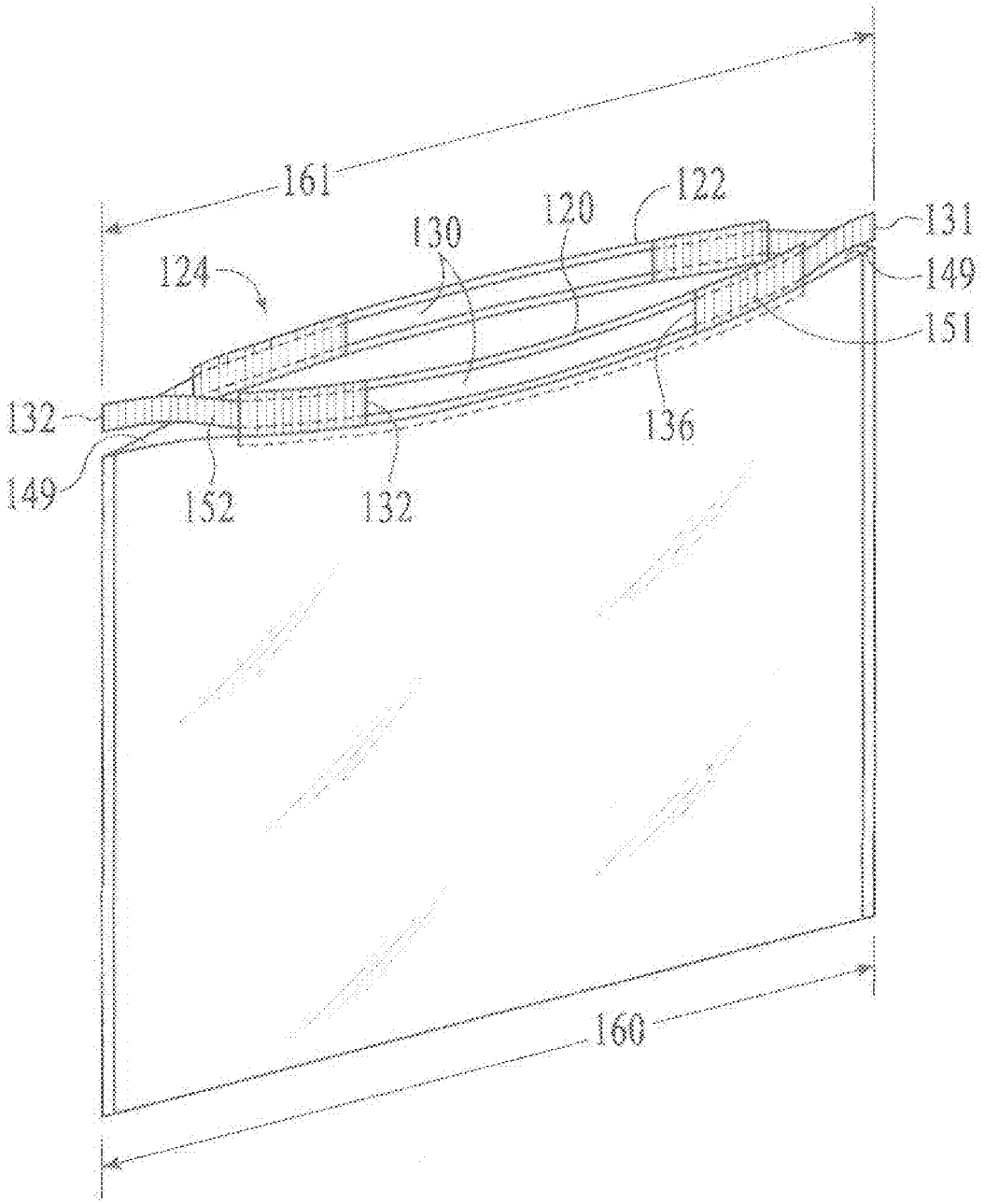
FIG. 7 is a perspective view of a thermoplastic bag having a draw tape in an extended state.
Figure 8:
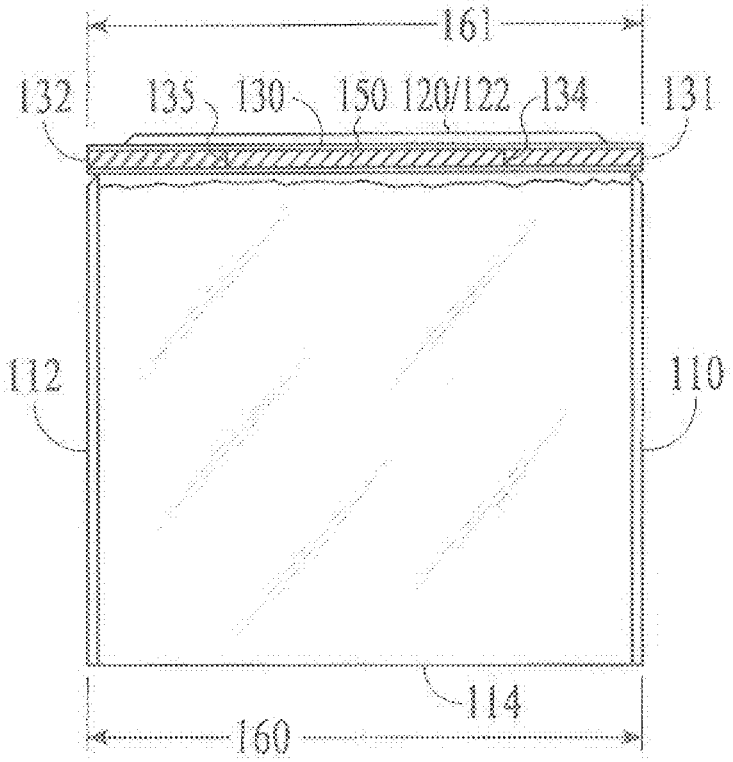
FIG. 8 is a partial cut away view of another embodiment of the bag having end cutout notches and the draw tape material having an attached stretched elastic strip.
Figure 9:
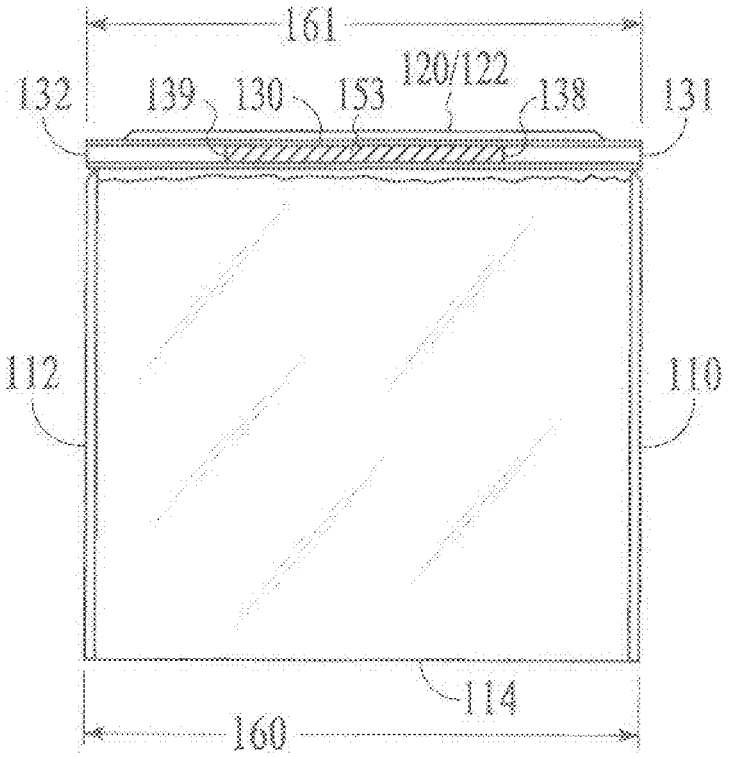
FIG. 9 is a partial cut away view of another embodiment of the bag having end cutout notches and the draw tape material having an attached stretched elastic strip.
Figure 10:
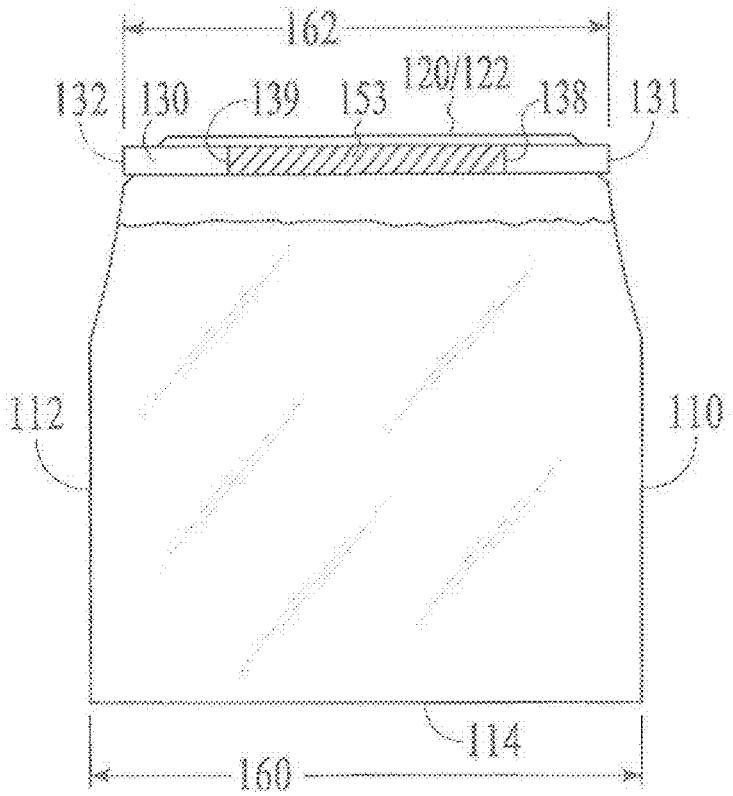
FIG. 10 is a partial cut away view the bag of FIG. 9 with the elastic strips in a relaxed condition.

In another embodiment, only the draw tape ends 131, 132 may be attached together to form a closed loop that is freely accommodated in the hems, such as, the bag shown in FIG. 7. The draw tape 130 may be accessed through the first and second end notches 149. Pulling the draw tape 130 through the notches 149 constricts the top edges 120, 122 thereby drawing closed the opening 124. One length of expanded stretched elastic strip 151 is attached to first end 131 and intermediate point 136 and another length of expanded stretched elastic strip 152 is attached to the draw tape 130 second end 132 and intermediate point 137. The extended draw tape 130 with the expanded stretched elastic strips 151, 152 has length 161 equal to the bottom length 160. Referring to FIG. 8, an expanded stretched elastic strip 150 may be attached to the extended draw tape 130 at the opposite first and second ends 131, 132 and at intermediate points 134, 135 in between. The extended draw tape 130 with the stretched elastic strip 150 has length 161 equal to the bottom length 160. Referring to FIG. 9, one length of expanded stretched elastic strip 153 is attached to the extended draw tape 130 at intermediate point 138 and at intermediate point 139. The extended draw tape 130 with the expanded stretched elastic strip 153 has length 161 equal to the bottom length 160. FIG. 10 shows that when the bag 100 of FIG. 9 is allowed to relax, so that the elastic strip 153 is allowed to relax into the unstretched condition, the bag 100 gathers so that the relaxed top length 162 is shorter than the bottom length 160. In all embodiments, the number of attached regions can be varied from 2, 3, 4, more than 4, or more than 10.

Attachment of the elastic strip to the draw tape can be achieved by adhesive, heat sealing, stitching, or other methods well known in the art. The elastic strip is illustrated in a prestretched expanded length condition where the strip is tensioned along the direction of the length of the draw tape. Placing the elastic strip in the stretched expanded length condition causes the draw tape 130 to bunch together when the elastic strip contracts to the relaxed condition, thereby constricting the opening 106, causing the sidewall 102 and the top edges 120, 122 to bunch together, and causing the bag 100 to assume a shirred appearance, as in FIG. 1.

Additionally, the draw tape 130 may have an elastic quality that allows it to expand and contract along its length. When the contracted draw tape 130 constricts the opening, the sidewall material at the top edges 120, 122 and/or the hems may gather or shirr together to provide a pleat-like appearance, as in FIG. 1. In one embodiment, the draw tape 130 may be made from an elastic material. For example, the elastic material may be low density polyethylene, very low density polyethylene, linear low density polyethylene, ultra low density polyethylene, or ethylene vinyl acetate, and may be formed in combinations and in single or multiple layers. The draw tape may have elastic characteristics which allow the draw tape to stretch or extend when under tension and which allow the draw tape to relax or retract when not under tension. Referring the FIG. 3-5, the draw tape 130 may be attached at the first and second edges 110, 112 with the side seals when the draw tape 130 is in an stretched state under tension. For example, the draw tape may be stretched from about 10% to about 30%, or from about 5% to about 50%, from its relaxed state. After the side seals are completed, the draw tape 130 will relax or retract and the draw tape contracts and narrows the mouth of the bag as shown in FIG. 6. Since the relaxed draw tape is shorter than the hem, the hem will gather and the gathered hem will make the "stretch to grip" feature of the draw tape apparent to the consumer. The shorter than normal draw tape also provides a potential reduction in the cost of material.

Figure 11:
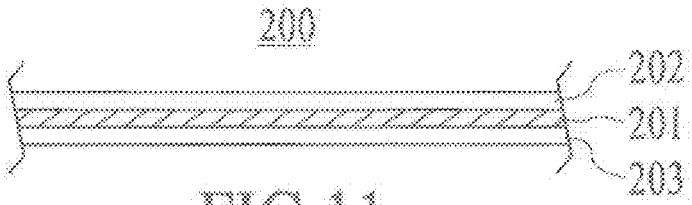
FIG. 11 is cross-sectional view of an embodiment of the elastic strip.

The elastic draw tape or strip can be made from any suitable material, such as, EVA (ethylene-vinyl acetate copolymer), VLDPE (very low density polyethylene), linear low density polyethylene, Lycra® by DuPont, EPDM (ethylene propylene diene monomer rubber), and rubber, for example. In some embodiments, the elastic strip may be provided as a multi-layer structure as illustrated in FIG. 11. For example, the elastic strip 200 can be made of a core layer 201 disposed between two skin layers 202, 203. The skin layers 202, 203 can facilitate attachment of the elastic strip 200 to the draw tape while the core 201 can provide the desired elastic properties, as describe in U.S. Pat. No. 6,939,042, which is hereby incorporated in its entirety by reference herein.

To provide the elastic characteristic, the draw tape 130 may be stretched prior to insertion in the hem. Pre-stretching may modify the elastic quality, for instance to change from relatively non-elastic to relatively elastic, of the draw tape allowing expansion and contraction and may facilitate stretching of the draw tape by a consumer during insertion of the bag into a receptacle. Pre-stretching may be accomplished by placing the draw tape under tension such as by pulling the ends of the draw tape to stretch it along its length. After insertion into the hem and attachment to the bag, the stretched draw tape may then be allowed to recover, at least in part, towards its original length. Recovery of the stretched tape may partially constrict the opening in a similar fashion to the above described embodiments of the bag. Thus, the pre-stretched tape is easier to stretch and expand when attaching to a container. Another possible advantage of pre-stretching the draw tape is that the pre-stretched draw tape retains or increases its tensile strength per unit thickness in the direction of stretch. This enables a greater quantity of draw tapes to be made from a single roll of draw tape material resulting in cost savings of material. In other embodiments, the pre-stretched draw tape may also be imparted with a pattern to modify the elastic characteristics.

Figure 12:
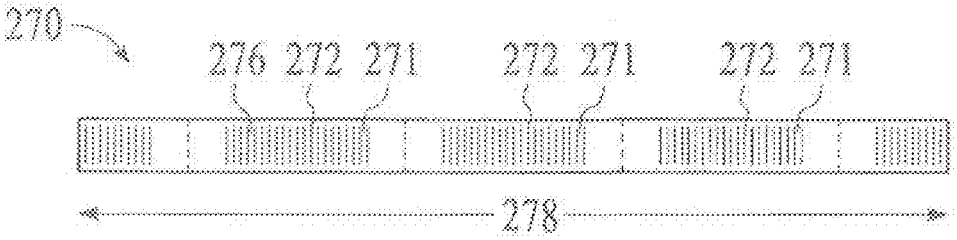
FIG. 12 is a partial cut away view of an embodiment of the bag having a patterned draw tape.

Referring to FIG. 12, the draw tape may be formed with a pattern. Formed intermittently along the length of the draw tape strip 270 may be multiple regions 271 of patterns 272. The patterns 272 may take the form of linearly arranged ribs 276 that may extend across the width of the strip 270. The ribs 276 may be parallel and adjacent to one another and perpendicular to the length of the strip 270 such that the thermoplastic material has a generally corrugated or wavy shape with the ribs bunched closely together. However, when a tensioning force is applied to the pattern 272 by, for example, pulling the strip in the direction 278, the ribs 276 may unfold thereby flattening the thermoplastic material out in a manner that causes the strip to expand in length. Additionally, the thermoplastic material of the strip may demonstrate shape memory or resiliency by which, when the tensioning force is released, the ribs 276 reform or refold thereby causing the strip 270 to contract. The pattern thereafter may regain its corrugated or wavy shape. Thus, as may be appreciated, the pattern 272 may provide the draw tape with an elastic quality. Patterns may also include decorative patterns, such as logos. Examples of such patterns and similar features are disclosed in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; and U.S. Pat. No. 6,695,476, each of which is herein incorporated by reference in its entirety and is set forth in its entirety herein. The draw tape 130 may include elastic characteristics as described herein, such as, the pre-stretched draw tape, the pre-stretched draw tape with a pattern, or the draw tape with a pattern and no pre-stretch.

Process

Figure 13:
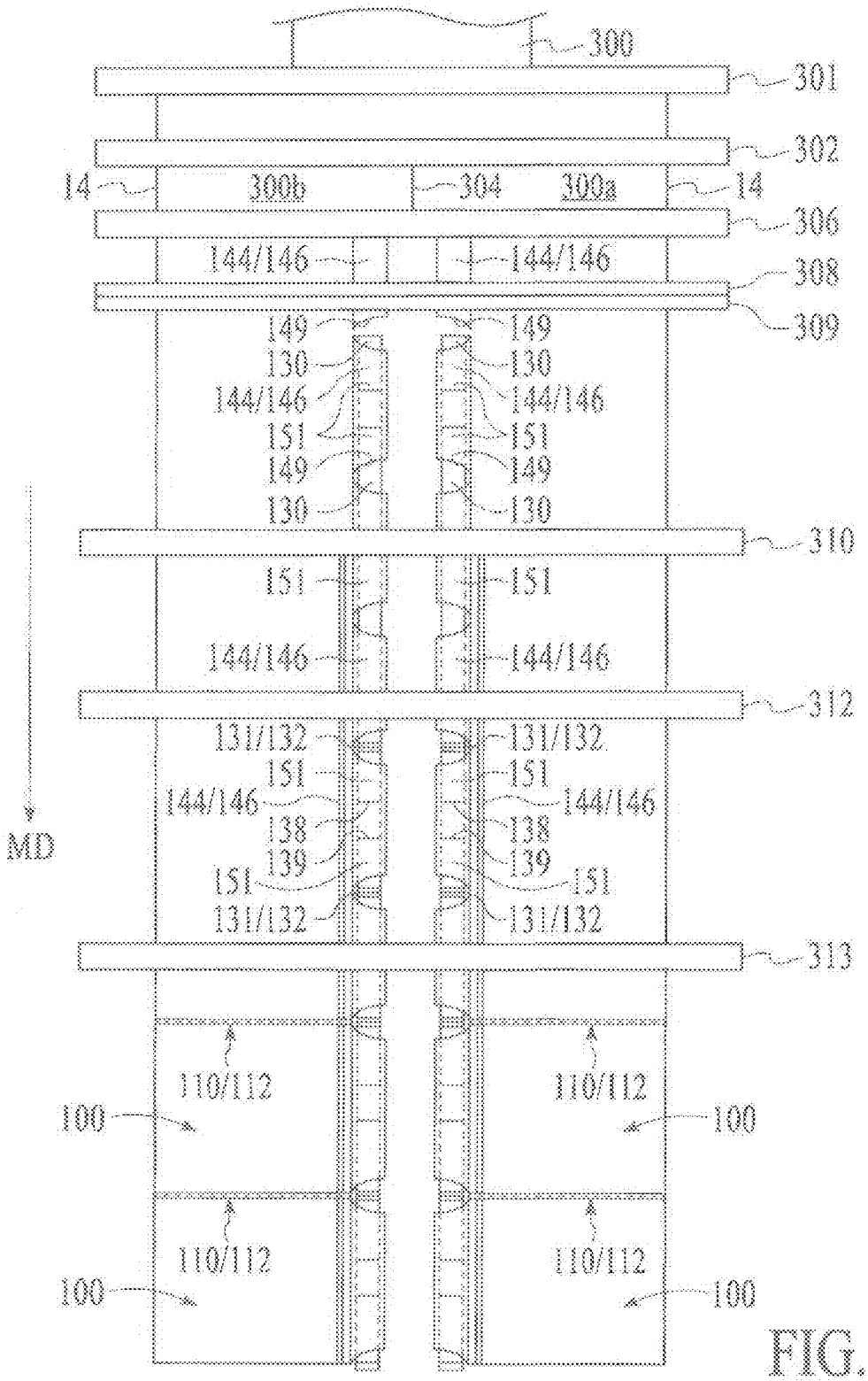
FIG. 13 is an illustration of an embodiment of a manufacturing process of the invention.

Referring to FIG. 13, there is illustrated an embodiment of a manufacturing process for producing the above-described bag. The manufacturing process is carried out by automated machinery operating continuously at high speeds. First, a thermoplastic tube 300 is extruded in a machine direction, flattened by rollers in a flattening mechanism 301, and then slit in half by a static slitting mechanism 302 along a center line 304. Each half 300*a* and 300*b* of the tube 300 includes a pair of pliable thermoplastic sheets joined to each other along a bottom 14 disposed in the machine direction. The machine direction is designated by an arrow labeled MD. The sheets are separable from each other along a mouth end proximate to center slit line 304 and opposite the bottom 14.

Second, the sheets are passed through a static folding mechanism 306 in the machine direction (MD) to produce a hem 144, 146 on each sheet along the mouth end. Third, a single-hole cutting mechanism 308 creates draw tape notches 149 in the hem 144, 146 on each sheet at regular distance intervals corresponding to a predetermined width of the draw tape bags 100 produced by the manufacturing method. The draw tape notches 149 in the hem 144, 146 on one of the sheets coincide with the respective draw tape notches in the hem on the other of the sheets.

Fourth, in mechanism 309, a pliable thermoplastic draw tape 130 from a supply roll (not shown) is continuously fed and inserted into the hem 144, 146 on each sheet. The drawtape 130 is extended corresponding to the predetermined width of the draw tape bags 100 produced by the manufacturing method. Prior to insertion, stretched elastomeric strips 151 are attached to the respective extended sections of the draw tape 130 as described above in connection with FIGS. 7-9, for example the intermediate seal 138, 139 (see FIG. 9). Fifth, a static heat sealing mechanism 310 generates a hem seal in the machine direction (MD) which attaches the hem 144, 146 on each sheet to the respective sheet.

Sixth, a heat sealing mechanism 312 generates draw tape seals 131, 132 which attach the draw tape 130 housed within the hem 144, 146 on the one of the sheets to the draw tape housed within the hem on the other of the sheets at the locations of the coinciding draw tape notches 149. These draw tape seals 131, 132 are transverse to the machine direction (MD). Seventh, a heat sealing and perforation mechanism 313 generates side seal structures 110, 112 transverse to the machine direction (MD) and disposed at regular distance intervals corresponding to the predetermined width of the draw tape bags 100 produced by the manufacturing method. Each side seal structure 110, 112 includes a perforation line disposed between a pair of spaced seal lines. The perforation line allows the sheets to be separated into the individual draw tape bags 100. The bags 100 may then be packaged in a dispensing box for sale to consumers.

Figure 14:
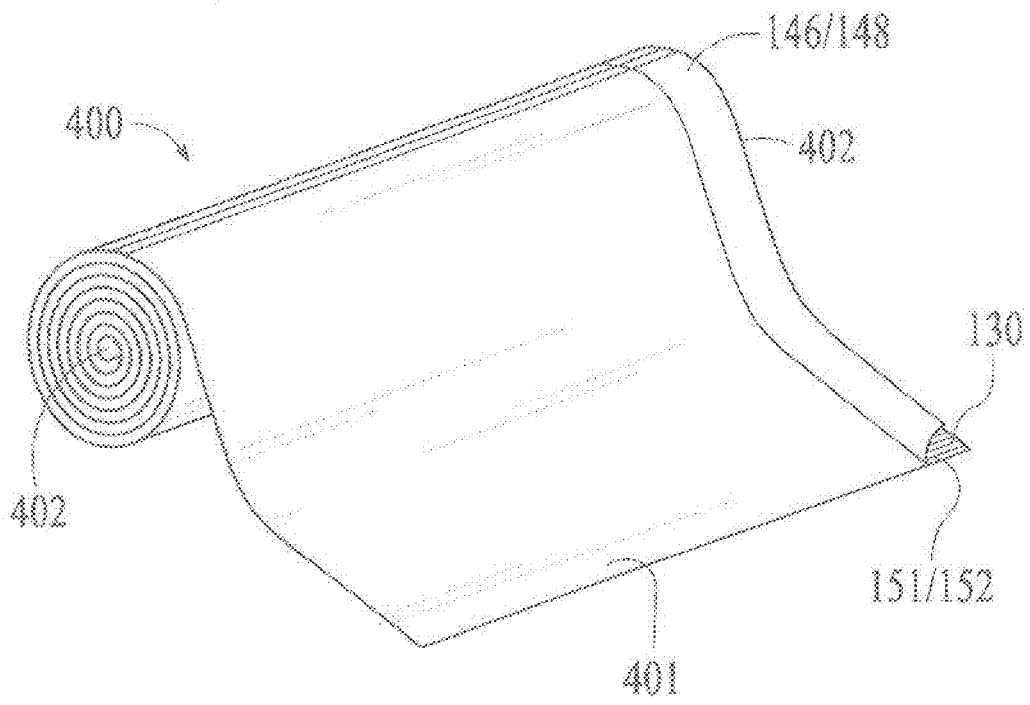
FIG. 14 is a perspective view of a roll of bags of the invention.

In one embodiment, the sheets can be continuously wound into a roll 400 by a winder. Prior to the winding operation, the sheets may pass through a V-folder assembly that folds the sheets into a smaller size. In the embodiment in FIG. 14, in which the sheets 401 are wound into a roll 400, the tension of the sheets 401 is preferably maintained so that the draw tape and stretched elastic strips remain in at least a partially stretched condition. In the embodiments in which the finished bags are distributed on a roll with the perforations intact, the bags can be tightly wound to prevent some of the stretched elastic strips from fully contracting and returning to their relaxed condition. For example, referring to FIG. 14, the sheets 401 and attached draw tape 130 with stretched elastic strips 151, 152 are wound around an axis 402 so that successive layers of the web and tape bury and hold the inner layers in at least a partially stretched condition. In some embodiments, to facilitate winding, a core may be provided at the winding operation around which the bag can be wound. Once the outermost bag is unwound from the roll 400 and detached along the perforation line, the tension is removed from the bag and the draw tape and elastic strip contracts to constrict the opening and gather the hem together. When the bags are detached along the perforation line, the bags can be interleaved in a stack, such as described in WO2007/146877 to Mack-Robles and U.S. Pat. No. 5,390,875 to Geitman, which are incorporated in their entirety herein.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A draw tape bag comprising:

a first sidewall;

a second sidewall, the second sidewall joined to the first sidewall by a closed bottom end, a first edge, and a second edge, thereby defining an opening of the draw tape bag at a top end;

the first and second sidewalls forming a hem having a top length and extending along the open top end disposed opposite the bottom end having a bottom length, the hem including one or more draw tape notches; and a flat pliable thermoplastic draw tape in an extended state housed within the hem, the flat pliable thermoplastic draw tape having an elastic characteristic that allows the flat pliable thermoplastic draw tape to expand and contract along a length of the flat pliable thermoplastic draw tape when subjected to loads consistent with insertion of the draw tape bag into a receptacle;

wherein the flat pliable thermoplastic draw tape is attached to the first and second sidewalls at a side seal and wherein the flat pliable thermoplastic draw tape, when in a relaxed state, causes the hem to gather and the opening of the draw tape bag to partially constrict;

wherein the flat pliable thermoplastic draw tape is formed by stretching an initial pliable thermoplastic draw tape, and wherein the elastic characteristic of the flat pliable thermoplastic draw tape is greater than an elastic characteristic of the initial pliable thermoplastic draw tape.

2. The draw tape bag of claim 1, wherein the flat pliable thermoplastic draw tape in an extended state is additionally pre-stretched.

3. The draw tape bag of claim 1, wherein the flat pliable thermoplastic draw tape comprises linear low-density polyethylene.

4. The draw tape bag of claim 1, further comprising:

a strip of elastic material having a fully relaxed length and a stretched expanded length, the elastic strip attached in the stretched expanded length condition to at least a first discrete region and a second discrete region of the extended flat pliable thermoplastic draw tape, and wherein the flat pliable thermoplastic draw tape and the strip of elastic material are sealed to each other within the hem and the elastic strip contracts to cause the flat pliable thermoplastic draw tape to bunch together such that the side seal is drawn inwardly and the hem is gathered together when the stretched elastic material attached to the flat pliable thermoplastic draw tape is allowed to relax.

5. The draw tape bag of claim 4, wherein the elastic strip is not attached to the hem.

6. The draw tape bag of claim 4, wherein:

the strip of elastic material is not attached to the hem;

the strip of elastic material is not attached to the first sidewall; and the strip of elastic material is not attached to the second sidewall.

7. The draw tape bag of claim 1, further comprising: a stretched elastomeric strip having a first end and a second end wherein the first and second ends are connected to a first portion and a second portion respectively of an extended section of the flat pliable thermoplastic draw tape and the elastic strip contracts to cause the flat pliable thermoplastic draw tape and the hem to bunch together and to draw inwardly the at least one side seal when the elastomeric strip is in a relaxed condition.

8. The draw tape bag of claim 7, wherein:

the strip of elastic material is not attached to the hem;

the strip of elastic material is not attached to the first sidewall; and the strip of elastic material is not attached to the second sidewall.

9. The draw tape bag of claim 1, further comprising a pattern in the flat pliable thermoplastic draw tape that modifies the elastic characteristic of the flat pliable thermoplastic draw tape.

10. The draw tape bag of claim 9, wherein the pattern of allows the flat pliable thermoplastic draw tape to stretch in the lengthwise direction.

11. The draw tape bag of claim 1, wherein the flat pliable thermoplastic draw tape retains or increases its tensile strength per unit thickness in the direction of stretch that provides the flat pliable thermoplastic draw tape with the elastic characteristic.

12. The draw tape bag of claim 1, wherein the flat pliable thermoplastic draw tape comprises linear low-density polyethylene and low-density polyethylene.

13. A draw tape bag, comprising:

a pair of pliable thermoplastic body panels joined to each other along a pair of opposing sides and a bottom bridging the opposing sides, the body panels forming a hem extending along a mouth end disposed opposite the bottom, the hem including one or more draw tape notches; and a flat pliable thermoplastic draw tape housed within the hem and being sealed together with the hem at least one side seal of the bag, the draw tape being partially exposed by the respective draw tape notches which allow the draw tape to be pulled therethrough to close the draw tape bag and to be used as a handle, the flat pliable thermoplastic draw tape having an elastic characteristic that allows the flat pliable thermoplastic draw tape to expand and contract along a length of the flat pliable thermoplastic draw tape when subjected to loads consistent with insertion of the draw tape bag into a receptacle, wherein the flat pliable thermoplastic draw tape is attached to the opposing sides of the thermoplastic body panels and wherein the flat pliable thermoplastic draw tape, when in a relaxed state, causes the hem to gather and an opening of the draw tape bag to partially constrict; wherein the flat pliable thermoplastic draw tape is formed by stretching an initial pliable thermoplastic draw tape, and wherein the elastic characteristic of the flat pliable thermoplastic draw tape is greater than an elastic characteristic of the initial pliable thermoplastic draw tape.

14. The draw tape bag of claim 13, wherein the length of the flat pliable thermoplastic draw tape in an extended state is equal to a length of the hem.

15. The draw tape bag of claim 14, wherein the flat pliable thermoplastic draw tape is sealed to the opposing sides of the thermoplastic body panels by a heat seal.

16. The draw tape bag of claim 13, wherein the flat pliable thermoplastic draw tape comprises linear low-density polyethylene.

17. The draw tape bag of claim 13, further comprising a pattern formed in the flat pliable thermoplastic draw tape that modifies the elastic characteristic of the flat pliable thermoplastic draw tape.

18. The draw tape bag of claim 17, wherein the pattern of allows the flat pliable thermoplastic draw tape to stretch in the lengthwise direction.

19. The draw tape bag of claim 13, wherein the flat pliable thermoplastic draw tape retains or increases its tensile strength per unit thickness in the direction of stretch that provides the flat pliable thermoplastic draw tape with the elastic characteristic.

20. The draw tape bag of claim 13, wherein the flat pliable thermoplastic draw tape comprises linear low-density polyethylene and low-density polyethylene.

* * * * *